United States Patent [19]

Da Costa

[11] Patent Number: 4,979,879

[45] Date of Patent: Dec. 25, 1990

[54] DISCHARGE SYSTEM FOR ROLLING PISTON ROTARY COMPRESSOR

[75] Inventor: Caio M. F. N. Da Costa, Joinville, Brazil

[73] Assignee: Empresa Brasileira de Compressores, S.A., Joinville, Brazil

[21] Appl. No.: 486,559

[22] Filed: Feb. 27, 1990

[30] Foreign Application Priority Data

Mar. 9, 1989 [BR] Brazil ..... 8901185

[51] Int. Cl.[5] ..... F04C 29/06

[52] U.S. Cl. ..... 417/312; 417/902

[58] Field of Search ..... 417/312, 902

[56] References Cited

U.S. PATENT DOCUMENTS 4,457,671 7/1984 Watanabe ..... 417/902 X

FOREIGN PATENT DOCUMENTS 60-56196 4/1985 Japan ..... 417/312

*Primary Examiner*—John C. Fox

*Attorney, Agent, or Firm*—Darby & Darby

[57] ABSTRACT

A discharge system for rolling piston rotary compressor, including a hermetic housing a cylinder block having a rolling piston assembled on an eccentric shaft supported by a pair of bearings assembled at opposed sides of the cylinder block. The first of said bearings is innerly shaped as a discharge muffler chamber open to the end face of said bearing which is turned to the cylinder block and closed by a valve plate directed seated against the end adjacent face of the cylinder block, said valve plate having an axial eccentrical discharge port communicating the interior of the cylinder block with a recess bottom having a blade discharge valve seat turned to the interior of the portion in the discharge muffler chamber. Such arrangement allows the valve plate to simultaneously work as a discharge muffler chamber cover and as an end wall of the cylinder block, and such arrangement can further be sized to have a minimum thickness which will only be enough to incoporate the blade valve housing recess and a small axial extension of the discharge port.

11 Claims, 3 Drawing Sheets

DISCHARGE SYSTEM FOR ROLLING PISTON ROTARY COMPRESSOR

BACKGROUND OF THE INVENTION

This invention refers to a rolling piston rotary compressor and, more particularly, to a discharge system for such compressor type which is usually used for small refrigerating systems.

Generally, rolling piston rotary compressors have direct suction and discharge into the housing, that is, they work under a high pressure within the housing. As a result, the gas which is within the housing becomes an excellent means to carry noise. Thus, the pulses in the discharge of compressed gas within the compressor assembly into the housing are carried by the gaseous means itself (the inner atmosphere in the housing under high pressure) reaching the housing walls which vibrate and thereby cause noise. Therefore, in this type of compressor it is very important to provide a good insulation against the pulses from the discharge gas and consequently against any noise thereby generated.

Another technical problem is one that, due to the arrangement of the parts in the assembly of a rolling piston rotary compressor, the walls of the housing covers, where the discharge port is usually placed, have to be thick (from 7 to 10 mm) to bear the high pressures produced within the compressor assembly. This causes the discharge port neck to be too long (from 3 to 5 mm) even when a recess in the outlet valve seat is used. This excessive extension increases the discharge flow pressure loss, thereby resulting in increasing the compressor energy consumption. Therefore, to reduce such energy loss, the discharge port neck in the compressor assembly has to be as short as possible.

U.S. Pat. No. 4,573,879 shows the discharge dampening system most commonly used in rolling piston rotary compressors. Basically, such known system has a muffler chamber with several volumes made of a stamped plate. Although it is a very simple solution, the disadvantage is that the plate which makes up the muffler chamber thickness is very small, thereby producing an incomplete dampening of the discharge flow noise, since the muffler chamber walls themselves vibrate thereby exciting pulses in the inner housing atmosphere that, in turn, carries such vibrations outside the compressor in noise form. A way which is usually used to increase the rigidity of the dampening chamber is shown in the drawing for the U.S. Pat. No. 4,636,154. In this arrangement, the muffler chamber volumes are formed on the compressor secondary bearing itself and covered by an outer cover in the form of a thick plate.

Some drawbacks to these approaches are that the manufacturing of the secondary bearing is complex, making it incompatible with the common machining processes. Therefore, the process of obtaining the secondary, bearing by metal powder sintering is usually employed. Also, in this process, the drawbacks inherent to the design complexity and the several compaction heights of the sinterized metal powder makes this part very expensive.

Another disadvantage of this solution is that the compressor assembly mounting screws have to be very long in size, which will probably cause some other problems concerning vibration and lack of rigidity in the compressor assembly.

It is also worthwhile saying that both of the prior art arrangements discussed above have a discharge port neck with a relatively long size, thus causing some pressure losses as already mentioned.

OBJECT OF THE INVENTION

It is an object of this invention to provide a discharge system for a rotary compressor solving the above mentioned problems and which can be executed by a simple manufacturing process.

BRIEF DESCRIPTION OF THE INVENTION

The discharge system of the invention is applied to a rotary rolling piston compressor of the type including a hermetic sealed housing which houses a cylinder block with a rolling piston assembled as an eccentric on a shaft. The shaft is supported on a pair of bearings in the form of annular peripheral plates mounted on the opposed sides of the cylinder block. The first bearing is integrally formed with a discharge muffler chamber open to one of the end faces of said bearing and closed by a cover. The discharge muffler chamber is in communication with the interior of the cylinder block through a discharge valve which is in association with a discharge port provided in the adjacent end wall of the cylinder block.

According to the invention, the discharge muffler chamber cover and the adjacent end wall of the cylinder block are defined by a valve plate provided between said first bearing and the cylinder block, having a thickness substantially less than that of the plates for both bearings. The valve plate is axially and eccentrically pierced by a discharge passage and provided with a recess for housing the valve in its end face which is faced to the discharge muffler chamber and communicates with the gas outlet end in the discharge passage.

The discharge system constructed in the way as briefly described above has several advantages. It has a rigid and stable construction. There is full insulation of the discharge flow pulses right at the discharge hole outlet. Also, the discharge hole is reduced in length to a minimum needed (from 1 to 1.5 mm), thereby minimizing the pressure loss at the discharge hole and the losses due to the dead volume as in the discharge holes in the prior art. This increases the efficiency of the compressor.

The screws used for mounting the compressor assembly can have their length reduced by providing recesses on the outer end face of the first bearing. This screw dimension reduction for attaching the assembly is not possible to be made in the second solution of the prior art discussed above because it is necessary that covering plate or cover of the muffler chamber be flat to ease its manufacturing process. As the first described bearing has no discharge valve seat, its manufacturing is greatly facilitated, and the shape of the muffler chamber volume can be made both by machining and simple sintering.

It is useful to point out that the small thickness of the valve plate of the subject invention, especially at the area where the discharge port is provided, is only possible because the body of the first bearing assures the rigidity needed by the assembly. This does not occur for any prior art solutions. Further, this invention also allows the valve plate assembly between the cylinder block and any one of the main and secondary bearings for such type of rotating rolling piston compressor. Such new solution further allows eventually the use of an insulating material joint between the valve plate and the peripheral plate of the adjacent bearing aiming at improving acoustic sealing.

BRIEF DESCRIPTION OF THE DRAWINGS

This invention will hereinafter be described with reference to the attached drawing, in which.

DETAILED DESCRIPTION OF THE INVENTION

Figure 1:
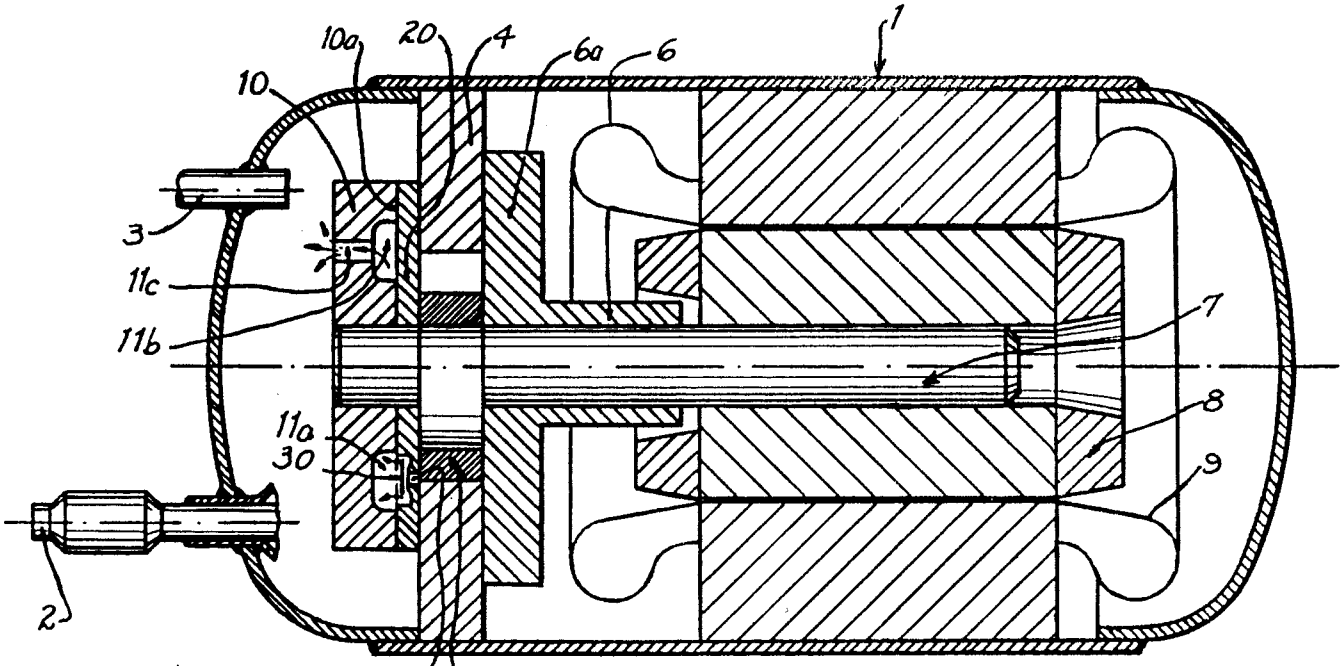
FIG. 1 shows a longitudinal section view of a rotary compressor including the discharge system.

The discharge system as illustrated in FIG. 1 is applied to a rotary compressor of the type comprising a hermetic sealed housing 1 having an end wall which has mounted therein a suction tube splicer coupling 2 and a discharge tube splicer 3. A cylinder block 4 is mounted within the housing and a piston 5 is provided, the latter being an eccentric part or a rotating shaft 7 which is driven by an electrical motor having a rotor 8 and stator 9.

The shaft 7 is supported on a main bearing 6 and a secondary bearing 10 mounted to the cylinder, respectively having a circular peripheral portion 6*a* and 10*a*. The peripheral portion of the main bearing 6 is shaped as a plate or peripheral flange which is directly seated against the adjacent end face of the cylinder block 4. As is well known, the cylinder 4, piston 5, and the bearing portions 6*a* and 10*a* form a compression and a suction chamber.

Figure 3:
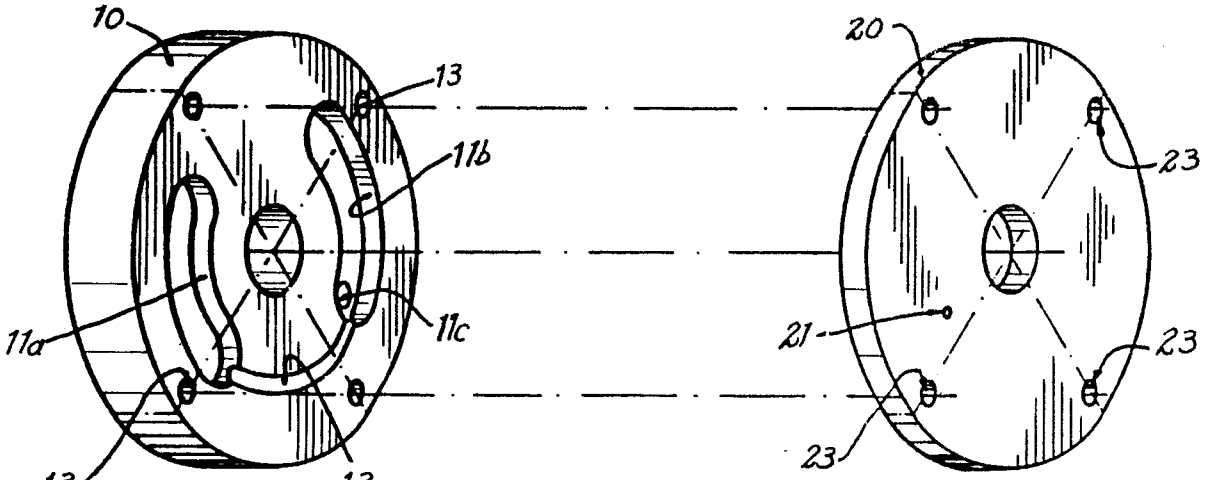
FIG. 3 shows an exploded perspective rear view of the first bearing and valve plate assembly as used in the assembly in FIG. 1.

In the illustrated embodiment, the secondary bearing 10 is shaped as a cylindrical block having its end face turned to the cylinder block 4, which is provided with two arcuate shaped diametrically opposed recesses 11*a* and 11*b* (see FIG. 3), defining the volumes of the discharge muffler chamber which is thus provided inside the secondary bearing body 10 itself. As seen in FIG. 3, said two recesses 11*a* and 11*b* are interconnected through a communication groove 12 provided in the inner end face of the secondary bearing 10.

Such construction arrangement allows a discharge muffler chamber to be manufactured in a very simple way, either by machining the cylinder block of the secondary bearing 10 or by manufacturing the latter by sintering. The secondary bearing is formed with a hole to provide communication between recess 11*b* and an eccentric axial port 11*c* extending to the outer end face of the secondary bearing. This functions as a gas outlet port to provide communication between the inner part of the discharge dampening chamber and the internal part of the hermetic housing 1.

As seen in FIG. 1, a valve plate 20 is interposed between the secondary bearing 10 and is attached to the adjacent end face of the cylinder block 4. Valve plate 20 is a flat circular disc with a thickness substantially less than that used for the peripheral portions 6*a* and 10*a* of the main and secondary bearings 6, 10 respectively. The valve plate 20 functions as an end wall of the cylinder block 4 and also as a discharge muffler chamber cover for arcuate recesses 11*a*, 11*b*. The valve plate 20 is provided with axial holes 23 (see FIGS. 2 and 3) which are angularly arranged away next to its peripheral edge and axially in alignment with corresponding through axial and peripheral holes 13 provided in the secondary bearing cylindrical block. The holes 23 are sized to allow the screws (not illustrated) to pass, which screws are responsible for fixing the secondary bearing-valve plate assembly adjacent to the cylinder block end face 4.

Figure 2:
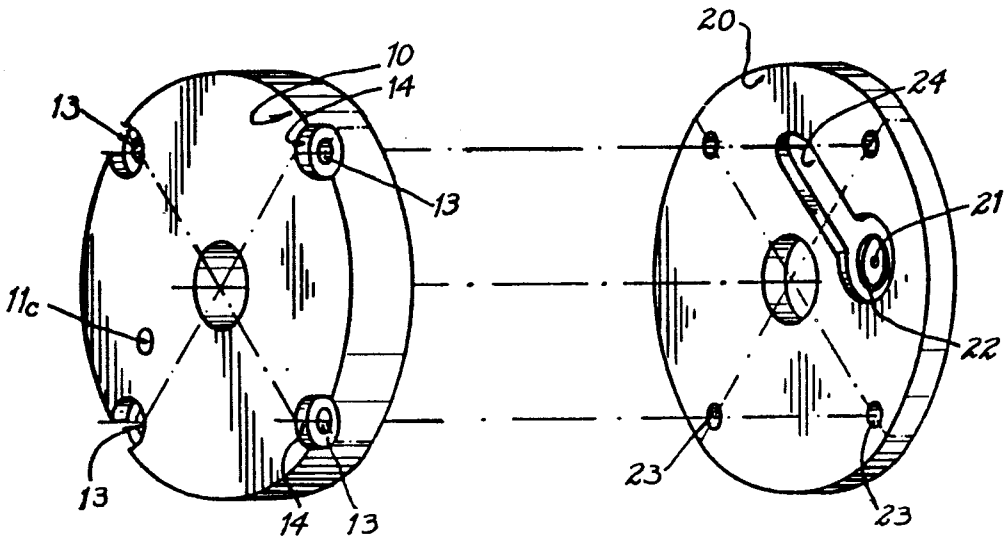
FIG. 2 shows an exploded front perspective view of the first bearing and valve plate assembly also illustrated in FIG. 1.

As seen in FIG. 2, the axial holes 13 of the secondary bearing 10 are provided at their outer ends with corresponding recesses 14 in the outer face of the secondary bearing 10. This allows said fixing screws to have their length reduced without impairing the assembly rigidity.

Also in accordance with FIG. 2, the valve plate 20 is provided with a discharge port 21 axially and eccentrically arranged in such way that it has its gas inlet end in communication with the interior of the cylinder block 4, i.e., the discharge or compression chamber, and its gas outlet end defining a valve seat 22 inside a recess 24 formed in the face of the valve plate 20 which faces the discharge muffler chamber recesses 11*a*–11*b* of the secondary bearing. The discharge port 21 and the recess 24 of the valve plate are positioned so as to communicate with the interior of the recess 11*a* of the secondary bearing 10 which is opposite to that from which the gas outlet port 11*c* extends.

A reed valve 30 of a known construction is located inside the recess 24 in the valve plate 20. The valve 30 being represented in a schematic way in FIG. 1. The discharge reed valve 30 will not be further described because it does not form part of this invention. Different constructions can be adopted without impairing the inventive concept of this invention.

Although not specifically illustrated, it will be understood that sealing joints or compounds can be used between the valve plate 20 and the adjacent bearing to increase the sealing characteristics at the junction regions for said constitutive elements of this discharge system.

In addition, it will also be noted that the valve plate 20 does not need to be strictly provided between the cylinder block 4 and the secondary bearing 10, since the discharge muffler chamber can be attached to the main bearing, causing the valve plate to be positioned between the main bearing and the cylinder block 4 without in any way modifying the solution now claimed.

With the new construction, the thickness of the valve plate 20 is only sized to satisfy the requirements relating to the making of recess 24 for housing the reed valve 30. This reduces substantially the extension or length of the discharge hole 21, since said valve plate is not any more responsible for providing any structural strength to the pressures existing inside the cylinder block 4. In the mounting of the bearing against the outer face of said valve plate 20, the latter will fully be supported by said bearing on which will be applied all of the forces resulting from the refrigerating gas compression inside the cylinder block.

Although it is herein described and illustrated only a preferred configuration of this invention it should be understood that several modifications can be made without departing from the inventive concept as defined in the claims.

I claim:

1. A compressor comprising:

a housing, a cylinder block within said housing, a rotatable shaft having a piston thereon for rotating within said cylinder, bearing means for said shaft including a plate on each side of said cylinder block and defining therewith and with the piston a suction chamber and a compression chamber, one of said bearing plates being formed with an integral muffler chamber, a valve plate mounted between said cylinder block and said one plate, said valve plate having a through passage one end of which in communication with one of the compression and suction chambers and the other end in communication with the muffler chamber of said one bearing plate, and valve means on said other end of said passage.

2. A compressor according to claim 1 wherein the thickness of said valve plate is substantially less than that of said one bearing plate.

3. A compressor according to claim 2 wherein said valve means includes a recess in the face of said valve plate facing the muffler chamber and a valve in said recess.

4. A compressor according to claim 3, wherein said valve means comprises a reed type valve.

5. A compressor according to claim 1 wherein the muffler chamber comprises a recess in said one bearing plate.

6. A compressor according to claim 5 wherein said one bearing plate has a pair of recesses forming the muffler chamber, and a passage on said one bearing plate providing communication between said pair of recesses, one of said recesses communicating with said other end of said valve plate passage and a passage formed through said bearing plate from the other chamber to the interior of the housing.

7. A compressor according to claim 6 wherein said recesses are arcuate.

8. A compressor as in claim 7 wherein said recesses are spaced and diametrically opposed to each other.

9. A discharge system according to claim 1, wherein the valve plate is attached by screws passing through holes in said one bearing plate and the valve plate which are axially aligned and attached to the cylinder block.

10. A discharge system according to claim 9, wherein the outer end of the screw holes in said one bearing plate is recessed in relation to the outer face of said one bearing plate.

11. A discharge system according to claim 1 further comprising suction and discharge tubes mounted to a wall of said housing, said one bearing being located at the side of the cylinder block facing said wall.

* * * * *

UNITED STATES PATENT AND TRADEMARK OFFICE

CERTIFICATE OF CORRECTION

PATENT NO. : 4,979,879

DATED : December 25, 1990

INVENTOR(S) : Caio M. F. N. Da Costa

It is certified that error appears in the above—identified patent and that said Letters Patent is hereby corrected as shown below:

On the title page:

Please correct the Assignee's name from "Empresa Brasileira de Compressores, S.A." to --Empresa Brasileira de Compressores S.A. - EMBRACO--.

Signed and Sealed this

Fifth Day of January, 1993

*Attest:*

*Attesting Officer*

DOUGLAS B. COMER

*Acting Commissioner of Patents and Trademarks*